United States Patent [19]

Reiferscheid

[11] Patent Number: 4,675,642

[45] Date of Patent: Jun. 23, 1987

[54] TEMPERATURE SWITCH

[75] Inventor: Norbert Reiferscheid, Camberg, Fed. Rep. of Germany

[73] Assignee: VDO Adolf Schindling AG, Frankfurt am Main, Fed. Rep. of Germany

[21] Appl. No.: 689,273

[22] Filed: Jan. 7, 1985

[30] Foreign Application Priority Data

Jan. 7, 1984 [DE] Fed. Rep. of Germany ..... 3400409

[51] Int. Cl.[4] ..... H01H 37/32

[52] U.S. Cl. ..... 337/140; 337/393

[58] Field of Search ..... 337/140, 139, 393, 394, 337/395, 383; 60/526

[56] References Cited

U.S. PATENT DOCUMENTS

| | | | |
|---|---|---|---|
| 3,594,674 | 7/1971 | Willson | 337/140 |
| 3,676,815 | 7/1972 | Du Rocher | 337/140 |
| 4,275,370 | 6/1981 | Sims | 337/140 |
| 4,356,478 | 10/1982 | Muggli et al. | 337/140 |
| 4,520,336 | 5/1985 | Hastings et al. | 337/140 |

FOREIGN PATENT DOCUMENTS

| | | | |
|---|---|---|---|
| 675473 | 7/1979 | U.S.S.R. | 337/140 |

*Primary Examiner*—Harold Broome

*Attorney, Agent, or Firm*—Martin A. Farber

[57] ABSTRACT

A temperature switch has an expansion element which consists of a metal alloy in which a martensitic structural transformation takes place within its working region, the phases concerned, austenite and martensite, having ordered lattice structures and the slightest possible difference in form. The expansion element preferably has the shape of a coil compression spring (7) which rests at one end against a bottom surface (9) of the housing (1) of the temperature switch and at the other end against a ram (4). This ram (4) serves to actuate a snap-switch mechanism (3) by which a switch contact (5) can be switched for movement against a fixed contact (6) or away from it.

2 Claims, 3 Drawing Figures

TEMPERATURE SWITCH

BACKGROUND OF THE INVENTION

The invention refers to a temperature switch having an expansion element which produces a change in path and force under the influence of a change in temperature for the actuation of a switch contact.

Temperature switches of this kind are required in the art for a very large number of uses, particularly as control switch or warning switch, and are generally well known. Wax enclosed in a wax boiler which is closed off by a membrane is frequently used as expansion element. Such an embodiment entails problems of leakage of the wax boiler and requires very great uniformity of the membrane in order that inaccurate measurement values are not obtained.

Temperature switches having a thermal bimetallic element as expansion element are also very commonplace. Such temperature switches lead to problems in adjustment and stability, due to the relative small changes in path of the thermal bimetal.

It is an object of the invention to develop a temperature switch of the aforementioned type which is as simple as possible to manufacture and the expansion element of which deforms as much as possible under the influence of temperature.

SUMMARY OF THE INVENTION

According to the invention, the expansion element (coil compression spring 7, strip of material 10) consists of a metal alloy in which a martensitic structural transformation takes place in the working region, the phases concerned— austenite and martensite— having orderly lattice structures and the slightest possible difference in form.

Such metal alloys have been known for some time under the name of "homogeneous form-memory alloys" (memory metal) and, within the temperature range which is decisive for most uses, they perform ten times more work than the expansion elements of the temperature switches used at the present time. The principal material for the expansion element of the invention is generally copper. As a result of structural transformations, the shape of the expansion element changes reversibly as a function of the temperature. The ordered lattice structure of the material has the result that, upon heating of the deformed martensite, the atoms can form the austenite phase only by certin movements. This results in the restoring of the original high-temperature form. By purposeful treatment of the material a desired low-temperature form can be established and thus a reversible form-changing behavior obtained.

By the use of such materials as expansion element in accordance with the invention, the problems which arise with the previously known temperature switches having wax or a bimetal, particularly the sealing problem in the case of wax and the adjustment and stability problem in the case of bimetals, are avoied.

One advantageous embodiment of the invention resides therein that the expansion element rests against a ram (4) which rests against a snap-switch mechanism (3) which actuates the switch contact (5). Such an embodiment is suitable, in particular, as control switch for high powers. The snap-mechanism as well as the ram can be taken over unchanged from the known temperature switches with wax boiler.

Particularly large changes in the path of the expansion element upon a change in temperature are obtained if the expansion element is a coil compression spring (7) one end of which is secured to the housing while its other end rests against the ram (4).

An alternative embodiment resides in the fact that the expansion element has the shape of a leaf spring both ends of which are fastened to the housing and which on its opposite side rests, between its points of support, against the ram (4).

A temperature switch of particularly simple construction is obtained if the expansion element is a strip of material (10) which is clamped on one end and on its free end bears a switch contact (12) which is movable against a fixed contact (13) by the bending of the expansion element.

A temperature switch which is very insensitive to blows and whose switch point can be simply and accurately adjusted is obtained if the expansion element is held by a positioning spring (14) against a stop (15) which limits the open position of the temperature switch. Such temperature switches are known, in particular, for use in automotive vehicles.

A particularly compact temperature switch is obtained if the expansion element (coil compression spring 7) rests against an axially displaceable contact bearer (16) on which the switch contact (17) which is movable against the fixed contact (21) is arranged.

The switch point of the temperature switch can be accurately adjusted in simple fashion if a compression spring (20) which rests at one end against the housing (1) of the temperature switch rests at the other end against the side of the contact support (16) which is opposite the coil compression spring (7).

Due to the fact that the stationary contact (21) is formed by a pin (18) which extends into the housing (1) coaxially to the switch contact (17) and is insulated from the housing (1), the temperature switch is particularly simple in construction. Furthermore, it can be assembled very rapidly.

BRIEF DESCRIPTION OF THE DRAWING

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
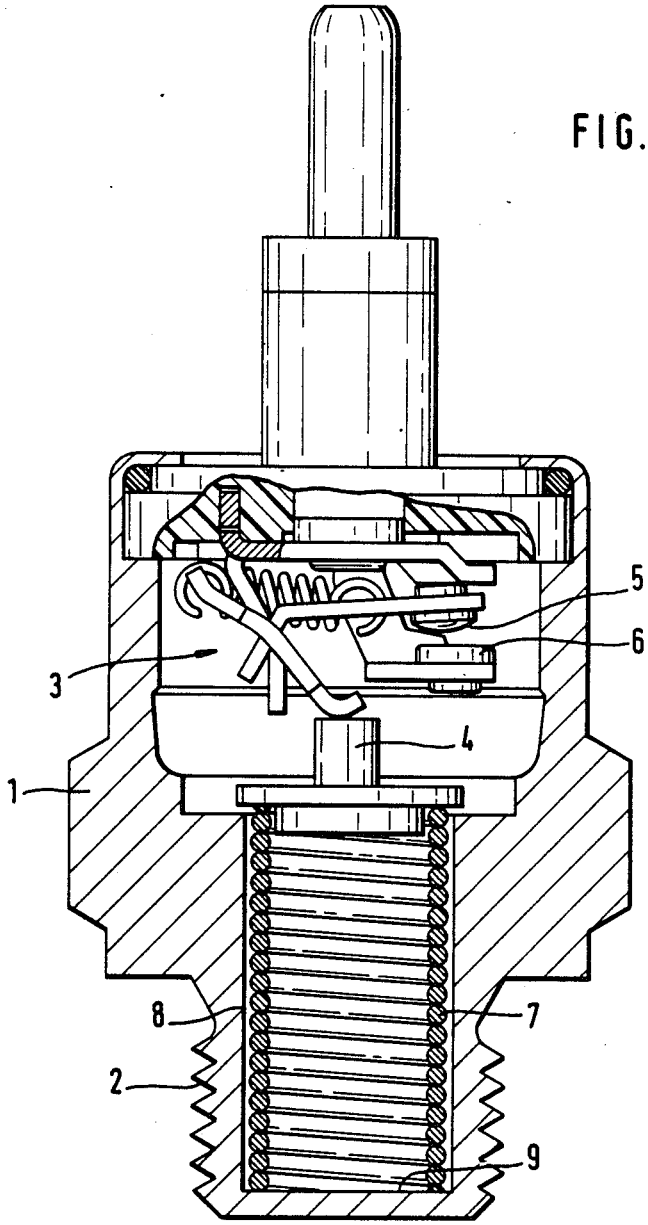
FIG. 1 is a longitudinal sectional through a first embodiment of a temperature switch developed according to the invention.

The temperature switch shown in FIG. 1 has a housing 1 which has an external thread 2 and can be screwed into a threaded borehole, not shown. In the upper part of the housing 1 there is a snap-switch mechanism 3 which can be actuated by a ram 4 and by which one switch contact 5 can be moved against a stationary contact 6 or away from it.

The ram 5 is moved by an expansion element which has the shape of a coil compression spring 7. This coil compression spring 7 is enclosed in a cylindrical working space 8 and rests at one end against a bottom surface 9 of said space 8 and on the other end against the ram 4.

Upon an increase in temperature, the coil compression spring 7 increases in height so that the ram 4 is lifted and the snap switch mechanism 3 actuated, with the result that the switch contact 5 suddenly jumps against the stationary contact 6. If the temperature then drops, the compression coil spring 7 deforms in opposite direction, so that switching is effected in the reverse direction.

Figure 2:
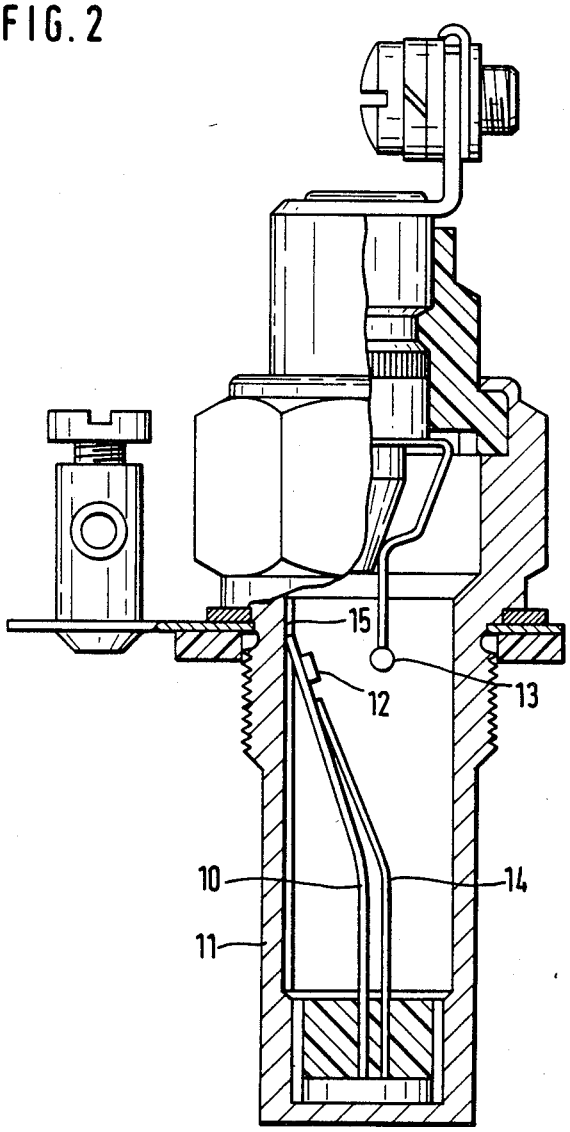
FIG. 2 is a longitudinal section through a second embodiment of a temperature switch developed according to the invention.

The temperature switch of FIG. 2 is similar to a thermal bimetal switch. Instead of a thermal bimetal, however, a strip of material 10 is clamped as expansion element at its one end in the housing 11 of the temperature switch. The strip of material 10 bears a switch contact 12 at its free end, the contact being movable against a stationary contact 13 upon the deformation of the strip of material 10, which leads to the closing of a circuit. It is essential for the invention that the strip of material 10 be held by a positioning spring 14, which is also leaf shaped, against a stop 15 which is arranged on the housing and limits the open position of the temperature switch. As a result of this positioning spring 14 which is clamped, in the same manner as the strip of material 10, at one end in the housing 11, the temperature switch is insensitive to vibrations such as occur in vehicles.

Figure 3:
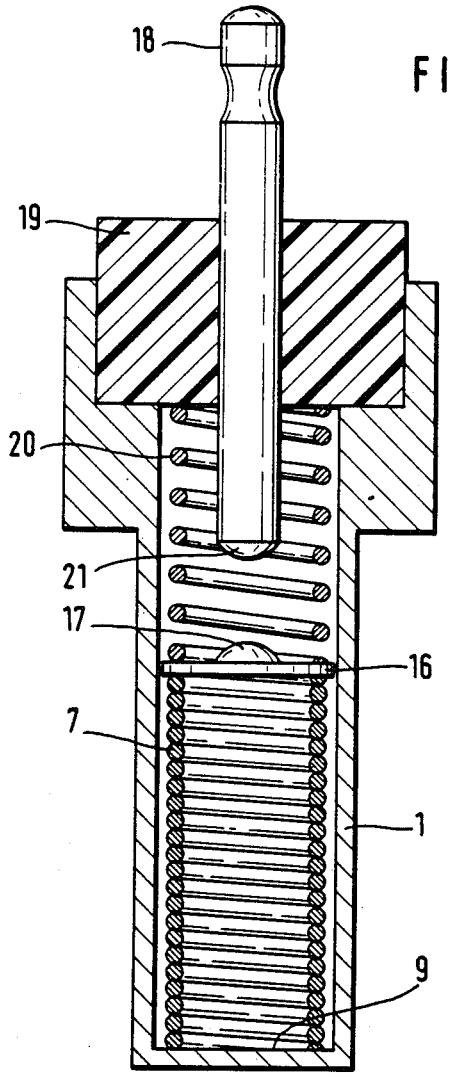
FIG. 3 is a longitudinal section through a third embodiment of a temperature switch developed according to the invention.

In the embodiment shown in FIG. 3, a coil compression spring 7 is provided as expansion element within a housing 1 in exactly the same way as in FIG. 1. It also sits against the bottom surface 9 of the housing 1; however it does not rest against a ram but against an axially displaceable contact carrier 16. This contact carrier 16 has a switch contact 17 which is electrically connected to the housing 1 via the contact carrier 16 and the coil compression spring 7.

A pin 18 which is held by an insulator 19 is introduced into the housing 1, coaxial to the contact carrier 16, the pin having no electric contact with the housing. The lower end surface of this pin 18 is developed as stationary contact 21 against which the switch contact 17 can be moved by the coil compression spring 7.

For the precise adjustment of the switch point there is provided a compression spring 20 which rests against the insulator 19 and against the contact carrier 16 on the side of the latter opposite the coil compression spring 7.

The most important feature of the invention in all embodiments is that the expansion element consists of a material of reversible temperature-dependent deformability. In both embodiments of the invention, the pressure of the expansion element which is produced by elongation is used to actuate a switch mechanism. Embodiments in which torsion or tension is used as drive force are, however, also conceivable.

The temperature at which the transformation between the austenite and the martensite phases takes place is dependent on the composition of the material of the spring, specifically the percentages of alloying metals and/or carbon which may be mixed with the base metal, such as copper or iron, from which the spring is fabricated. The shift in microstructure of the spring material associated with the change in phase introduces a dimensional change with corresponding movement of the spring and the development of a sufficiently large spring force for precise actuation of a switch. Suitable combinations of material for the selection of specific temperatures of the transformations are available in the metallurgical literature. The switch of the invention operates reliably to switch repeatedly at the desired temperature.

It is to be understood that other embodiments of the invention may occur to those skilled in the art. Accordingly, this invention is not to be regarded as limited to the embodiments disclosed herein, but is to be limited only as defined by the appended claims.

I claim:

1. A temperature switch having an expansion element which produces a deformation and a change in force under the influence of a change in temperature for the actuation of a switch contact, wherein said expansion element comprises a metal alloy in which a martensitic structural transformation takes place in the working region, the phases concerned—austenite and martensite - having orderly lattice structures and the slightest possible difference in form, said switch comprising a housing with said switch contact and a fixed contact therein, and wherein said expansion element further comprises a strip of material which is clamped to said housing on one end and on its opposite free end bears said switch contact, said switch contact being movable against said fixed contact by a bending of the expansion element, said switch further comprising a positioning spring and a stop located within said housing and wherein said expansion element is held by said positioning spring against said stop which limits the open position of the temperature switch.

2. A temperature switch having an expansion element which produces a deformation and a change in force under the influence of a change in temperature for the actuation of a switch contact, wherein said expansion element comprises a metal alloy in which a martensitic structural transformation takes place in the working region, the phases concerned - austenite and martensite - having orderly lattice structures and the slightest possible difference in form, said switch comprising a movable switch contact, a contact bearer displaceable axially along an axis of said expansion element for supporting said switch contact, and wherein said expansion element carries said contact bearer for movement of said switch contact against said fixed contact, said switch further comprising a compression spring and a housing enclosing said expansion element, and wherein said expansion element is a spring coil, said compression spring having one end abutting against said housing and another end abutting against the side of the contact bearer which is opposite the spring coil, and said fixed contact is formed by a pin which extends into said housing coaxially to said switch contact and is insulated from the housing.

* * * * *